US008162472B2

(12) United States Patent
Williamson et al.

(10) Patent No.: US 8,162,472 B2
(45) Date of Patent: Apr. 24, 2012

(54) APPARATUS AND METHOD FOR METERING FLUID FILM IN AN INK JET PRINTING SYSTEM

(75) Inventors: Brendan H. Williamson, Rochester, NY (US); David P. Van Bortel, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 723 days.

(21) Appl. No.: 12/212,230

(22) Filed: Sep. 17, 2008

(65) Prior Publication Data

US 2010/0066792 A1 Mar. 18, 2010

(51) Int. Cl.
*B41J 2/01* (2006.01)

(52) U.S. Cl. ..... 347/103; 399/325

(58) Field of Classification Search ..... 347/85, 347/91, 101–105; 399/325
See application file for complete search history.

(56) References Cited

U.S. PATENT DOCUMENTS

| | | | | |
|---|---|---|---|---|
| 4,214,549 | A | 7/1980 | Moser | |
| 6,190,771 | B1 | 2/2001 | Chen et al. | |
| 6,716,562 | B2 * | 4/2004 | Uehara et al. | 430/125.3 |
| 6,795,677 | B2 | 9/2004 | Berkes et al. | |
| 7,046,948 | B1 * | 5/2006 | Zess et al. | 399/325 |
| 7,155,154 | B2 | 12/2006 | Uehara et al. | |
| 7,281,790 | B2 * | 10/2007 | Mouri et al. | 347/103 |
| 7,296,882 | B2 | 11/2007 | Buehler et al. | |
| 7,319,838 | B2 | 1/2008 | Baba et al. | |
| 7,661,809 | B2 * | 2/2010 | Taniuchi et al. | 347/103 |
| 7,840,170 | B2 * | 11/2010 | Williamson et al. | 399/325 |
| 7,879,416 | B2 * | 2/2011 | Hashimoto et al. | 428/32.34 |
| 7,881,649 | B2 * | 2/2011 | Van Bortel et al. | 399/325 |
| 7,887,177 | B2 * | 2/2011 | Doi et al. | 347/103 |
| 2005/0015987 | A1 | 1/2005 | Berg | |
| 2006/0239728 | A1 | 10/2006 | Van Bortel | |
| 2008/0037069 | A1 | 2/2008 | Mestha et al. | |

OTHER PUBLICATIONS

Patricia Lai et al.; The Relationship Between Paper Properties and Fuser Oil Uptake in High-Speed Digital Xerographic Printing; Journal of Imaging Science and Technology; 2007 vol. 51, No. 5, pp. 424-430.

* cited by examiner

*Primary Examiner* — Daniel Petkovsek
(74) *Attorney, Agent, or Firm* — Ronald E. Prass, Jr.; Prass LLP

(57) ABSTRACT

An apparatus (100) and method that meters fluid film in an ink jet printing system is disclosed. The apparatus can include a source of fluid film (110) and a source metering assembly (120) rotatably supported in the apparatus. The source metering assembly can have a source metering assembly surface (122) coupled to the source of fluid film and the source metering assembly surface can be configured to transport fluid film from the source of fluid film. The apparatus can include a donor assembly (140) rotatably supported in the apparatus, where the donor assembly can have a donor assembly surface (142) coupled to the source metering assembly surface and the donor assembly surface can be configured to transport fluid film from the source metering assembly surface. The apparatus can include an ink jet printhead (195) configured to emit ink and a print assembly (170) rotatably supported in the apparatus. The print assembly can have a print assembly surface (172) coupled to the donor assembly surface, where the print assembly surface can be configured to transport fluid film from the donor assembly surface and the print assembly can be configured to receive ink from the ink jet printhead and produce an image on media using the ink.

14 Claims, 7 Drawing Sheets

APPARATUS AND METHOD FOR METERING FLUID FILM IN AN INK JET PRINTING SYSTEM

RELATED APPLICATIONS

This application is related to the application entitled "Apparatus and Method for Metering Fluid Film in an Image Fusing System," U.S. patent application Ser. No. 12/212,201, now U.S. Pat. No. 7,840,170, and the application entitled "Liquid Supply Systems, Fusers and Methods of Supplying Liquids in Printing Apparatuses," U.S. patent application Ser. No. 12/212,139, now U.S. Pat. No. 7,881,649, each of which is filed on the same date as the present application, each of which is commonly assigned to the assignee of the present application, and each of which is incorporated herein by reference in its entirety.

BACKGROUND

Disclosed herein is an apparatus and method that meters fluid film in an ink jet printing system that levels or fixes liquid-ink images using ink-jet printing.

Presently, ink jet printing includes ejecting or jetting drops of liquid ink from selected nozzles of a printhead to form an image on a media substrate, such as paper. Some ink jet printers receive ink in its liquid form from containers. Other printers receive ink in a solid form.

Polydimethylsiloxane (PDMS) or other release fluid or agent can be used to promote release of the ink and media from surfaces in an ink jet printer, which can extend the usable life of the printer. Unfortunately, excessive amounts of release fluid on printer surfaces can transfer to the media and contaminate it. Applying a correct amount of release fluid to printer surfaces using a release agent management system can mitigate transfer to the media, optimize post processing performance, and lower run costs for a user.

For example, printer surfaces using release fluid can produce 2 to 100 ml of the release fluid on media. High levels of release fluid application on the media is deleterious to achieving good performance for numerous post printing operations, such as hot melt adhesive application for book binding, hot and cold laminating film application, mailing tab and label application, pressure seal application, and other printing operations. Lower release fluid levels broaden the scope of the applications that can be used on prints. On the other end of the spectrum some media demand the higher levels of release fluid on media in order to deliver acceptable printer surface life and performance. Unfortunately, release fluid application rates are not adjustable in the printer either automatically or manually.

A release agent management system that controls the amount of release fluid consists of a hard roller and a rubber roller for applying release fluid to the printer surfaces. The amount of release fluid is controlled by a metering blade riding the hard roll. This blade is critical for controlling the quality and uniformity of the release fluid. However, blades that produce acceptable films are typically difficult to manufacture, due to the edge quality requirements. Insufficient blade edge quality causes a printing system to become susceptible to producing streaks from high levels or low levels of release fluid. Dry streaks and dirt problems are exacerbated by trying to run the system at low levels of release fluid application.

For example, attempts to reduce the fluid application rate in a conventional release agent management system usually entail making the metering blade edge sharper, reducing the fluid viscosity, increasing the metering blade tip loading, and/or making a metering roller smoother. All of these management attempts can lead to increased frequency of streaks and dirt problems. To elaborate, as the ratio between blade defect size and the nominal fluid film thickness approaches 1:1 and greater, any manufacturing defect in the blade edge produces a wet streak from a hole or depression in the blade, and a dry streak from a protrusion or dirt on the edge of the blade. In addition, sensitivity to dirt and other debris increases as the fluid film thickness is decreased and increased streaking occurs when the debris lodges under a blade contact point at a roller. The streaks can impact image quality and precipitate a service call for release agent management system servicing.

Thus, there is a need for an apparatus and method that meters fluid film in an ink jet printing system.

SUMMARY

An apparatus and method that meters fluid film in an ink jet printing system is disclosed. The apparatus can include a source of fluid film and a source metering assembly rotatably supported in the apparatus. The source metering assembly can have a source metering assembly surface coupled to the source of fluid film and the source metering assembly surface can be configured to transport fluid film from the source of fluid film. The apparatus can include a donor assembly rotatably supported in the apparatus, where the donor assembly can have a donor assembly surface coupled to the source metering assembly surface and the donor assembly surface can be configured to transport fluid film from the source metering assembly surface. The apparatus can include an ink jet printhead configured to emit ink and a print assembly rotatably supported in the apparatus. The print assembly can have a print assembly surface coupled to the donor assembly surface, where the print assembly surface can be configured to transport fluid film from the donor assembly surface and the print assembly can be configured to receive ink from the ink jet printhead and produce an image on media using the ink.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
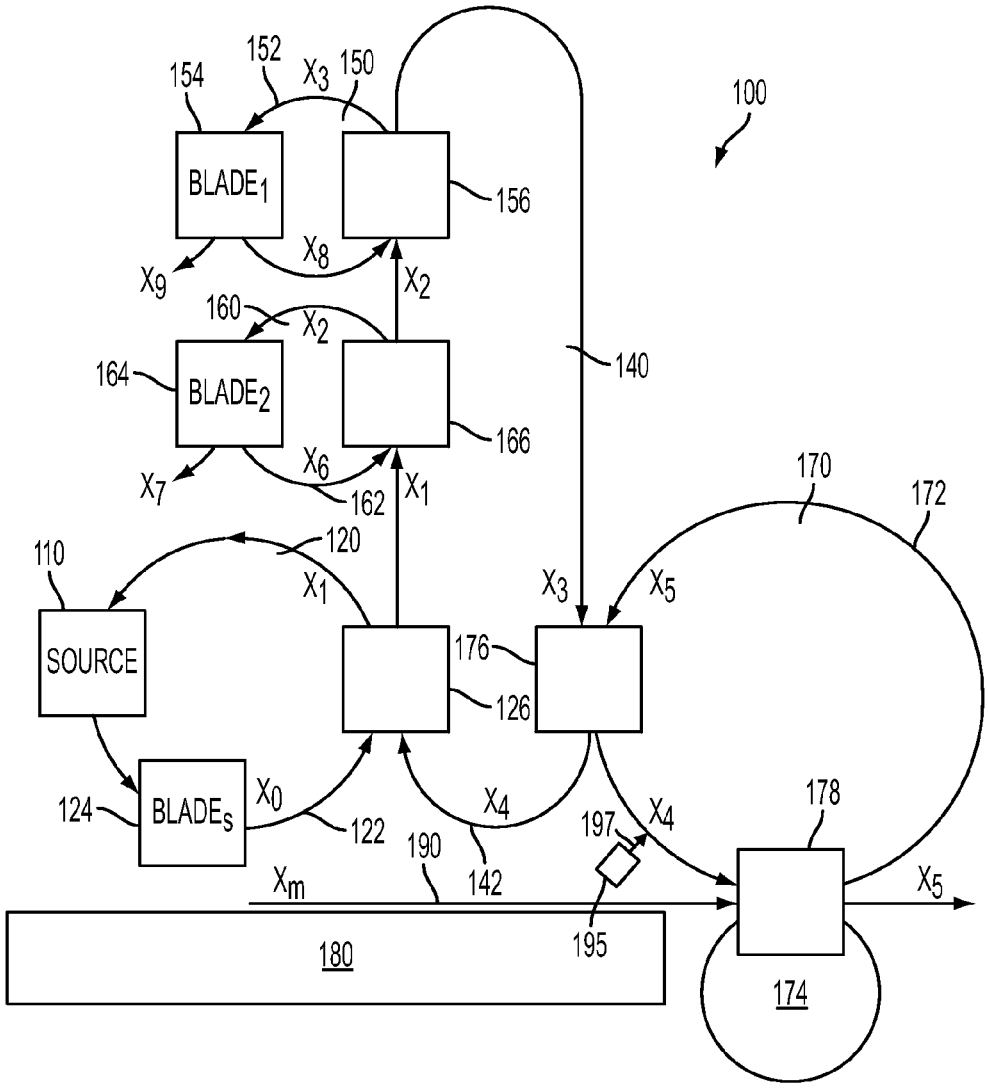
FIG. 1 is an exemplary illustration of an apparatus.

The embodiments include an apparatus for metering fluid film in an ink jet printing system. The apparatus can include a source of fluid film and a source metering assembly rotatably supported in the apparatus. The source metering assembly can have a source metering assembly surface coupled to the source of fluid film and the source metering assembly surface can be configured to transport fluid film from the source of fluid film. The apparatus can include a donor assembly rotatably supported in the apparatus, where the donor assembly can have a donor assembly surface coupled to the source metering assembly surface and the donor assembly surface can be configured to transport fluid film from the source metering assembly surface. The apparatus can include an ink jet printhead configured to emit ink and a print assembly rotatably supported in the apparatus. The print assembly can have a print assembly surface coupled to the donor assembly surface, where the print assembly surface can be configured to transport fluid film from the donor assembly surface and the print assembly can be configured to receive ink from the ink jet printhead and produce an image on media using the ink.

The embodiments further include an apparatus for metering fluid film in an ink jet printing system. The apparatus can include a media transport configured to transport media and a source of release agent. The apparatus can include a source metering assembly rotatably supported in the apparatus, where the source metering assembly can have a source metering assembly surface coupled to the source of release agent and the source metering assembly surface can be configured to transport release agent. The apparatus can include a donor assembly having a donor assembly surface coupled to the source metering assembly surface at a source nip, where the donor assembly surface can be configured to transport release agent from the source metering assembly surface. The apparatus can include a print assembly having a print assembly surface coupled to the donor assembly surface, where the print assembly surface can be configured to transport reduced release agent transported from the donor assembly surface. The apparatus can include an ink jet printhead configured to emit ink onto the print assembly surface. The apparatus can include an ink jet supply coupled to the ink jet printhead, where the ink jet supply can be configured to deliver the ink to the ink jet printhead. The print assembly can be configured and produce an image on the media using the ink from the ink jet printhead.

The embodiments further include a method of metering fluid film in an apparatus useful in inkjet printing, the apparatus including a source of release agent, a source metering assembly rotatably supported in the apparatus, the source metering assembly having a source metering assembly surface coupled to the source of release agent, a donor assembly rotatably supported in the apparatus, the donor assembly having a donor assembly surface coupled to the source metering assembly surface, a metering roll rotatably supported in the apparatus, the metering roll having a metering roll surface coupled to the donor assembly surface, a print assembly rotatably supported in the apparatus, the print assembly having a print assembly surface coupled to the donor assembly surface, and an inkjet printhead. The method can include transporting source release agent on the source metering assembly surface from the source of release agent. The method can include transporting donor assembly release agent on the donor assembly surface from the source release agent on the source metering assembly surface. The method can include reducing release agent on the donor assembly surface by transporting metering roll release agent on the metering roll surface from the donor assembly release agent on the donor assembly surface to obtain reduced release agent on the donor assembly surface. The method can include transporting print assembly release agent on the print assembly surface from the reduced donor assembly release agent on the donor assembly surface. The method can include transporting ink on the print assembly surface from the ink jet printhead along with transporting print assembly release agent.

FIG. 1 is an exemplary illustration of an apparatus 100. The apparatus 100 may be a printer, a multifunction media device, an ink jet printer, or any other device that produces an ink image on media. The apparatus 100 can include a source of fluid film 110. The fluid film can be a release agent, a lubricant, an ink, a thin film, oil, silicon oil, or any other liquid. A release agent can minimize toner offset on a print assembly, can provide for separation of media from the print assembly, and can provide other release agent properties. The apparatus 100 can include a source metering assembly 120 rotatably supported in the apparatus 100. The source metering assembly 120 can have a source metering assembly surface 122 coupled to the source of fluid film 110. The source of fluid film 110 may be a fluid film sump and the source metering assembly surface 122 may be partially submerged in the fluid film sump. The source metering assembly surface 122 can be configured to transport fluid film from the source of fluid film 110. Stages of transportation of the fluid film can be indicated by x, where $x_n$ may represent an amount of fluid film on different surfaces at different locations where n can be 1-9 and $x_m$ can indicate initial fluid film on media 190 which may be zero. A source metering roll blade 124 can be coupled to the source metering assembly surface 122. The source metering roll blade 124 can meter, such as trim or remove, fluid film on the source metering assembly surface 122.

The apparatus 100 can include a donor assembly 140 having a donor assembly surface 142 coupled to the source metering assembly surface 122. The donor assembly surface 142 can be configured to transport fluid film from the source metering assembly surface 122. The apparatus 100 can include at least one second metering roll 150 rotatably supported in the apparatus 100. The second metering roll 150 can have a second metering roll surface 152 coupled to the donor assembly surface 142. The second metering roll surface 152 can be configured to transport fluid film from the donor assembly surface 142. A second metering roll blade 154 can be coupled to the second metering roll surface 152. The second metering roll blade 154 can be configured to remove an amount of fluid film from the second metering roll surface 152. The second metering roll blade 154 can be variably coupled to the second metering roll surface 152 to vary the removal of fluid film from the second metering roll surface 152 by the second metering roll blade 154. The second metering roll blade 154 can also be decoupled from the second metering roll surface 152.

The second metering roll surface 152 can be detachably coupled to the donor assembly surface 142. Thus, a number of metering rolls engaged with the donor assembly surface 142 can be varied to provide for variable fluid film delivery rates. For example, the apparatus 100 can include a third metering roll 160 rotatably supported in the apparatus 100. The third metering roll 160 can have a third metering roll surface 162 coupled to the donor assembly surface 142. The third metering roll surface 162 may be detachably coupled to the donor assembly surface 142. The third metering roll surface 162 can be configured to transport fluid film from the donor assembly surface 142. A third metering roll blade 164 can also be coupled to the third metering roll surface 162. Additional metering rolls may also be coupled to the donor assembly surface 142.

The second metering roll 150 can be configured to return fluid film to the source of fluid film 110. For example, the second metering roll 150 can use gravity, a belt, a pump, or other methods to return the fluid film to a release agent management pan (not shown) of the source of fluid film 110. The second metering roll blade 154 can also be used return the fluid film to the source of fluid film 110. Additionally, multiple metering rolls coupled to the donor assembly surface 142 can return the fluid film to the source of fluid film 110.

The apparatus 100 can include an ink jet printhead 195 configured to emit ink 197. The apparatus 100 can include a print assembly 170 rotatably supported in the apparatus, the print assembly 170 having a print assembly surface 172 coupled to the donor assembly surface 142. As used herein, a "print assembly" shall be defined as any assembly that can transport fluid film and generate an ink image on media. For example, a print assembly can be a rotatable print assembly, such as a print member like a print roll, a print belt, a print drum, or any other assembly that can transport fluid film and generate an ink image on media. The print assembly surface 172 can be configured to transport fluid film from the donor assembly surface 142. Thus, the source metering assembly 120 can transport fluid film from the source of fluid film 110 to the donor assembly 140, which can transport fluid film from the source metering assembly 120 to the print assembly 170. The second metering roll surface 152 can be configured to reduce fluid film on the donor assembly surface 142 by transporting fluid film away from the donor assembly surface 142. The second metering roll surface 152 can reduce the fluid film on the donor assembly surface 142 transported from the source metering assembly surface 122. The print assembly surface 172 can then transport the reduced fluid film from the donor assembly surface 142.

The print assembly 170 can be configured to generate an image on media 190 from ink 197 from the ink jet printhead 195. The print assembly 170 can include a pressure roll 174 coupled to the print assembly 170 at a print nip 178. The pressure roll 174 can exert pressure against the print assembly 170 to generate an image on the media 190. The source metering assembly 120 can be a source metering roll, a source metering belt, a source metering drum, or any other source metering assembly that can transport fluid film from a source of fluid film. The print assembly 170 can be a print roll, a print belt, a print drum, or any other print assembly that can transport fluid film from a donor assembly, receive ink from an ink jet printhead, and produce an image on media using the ink. The donor assembly 140 can be a donor roll, a donor belt, a donor drum, or any other donor assembly configured to transport fluid film from a source metering assembly.

Figure 2:
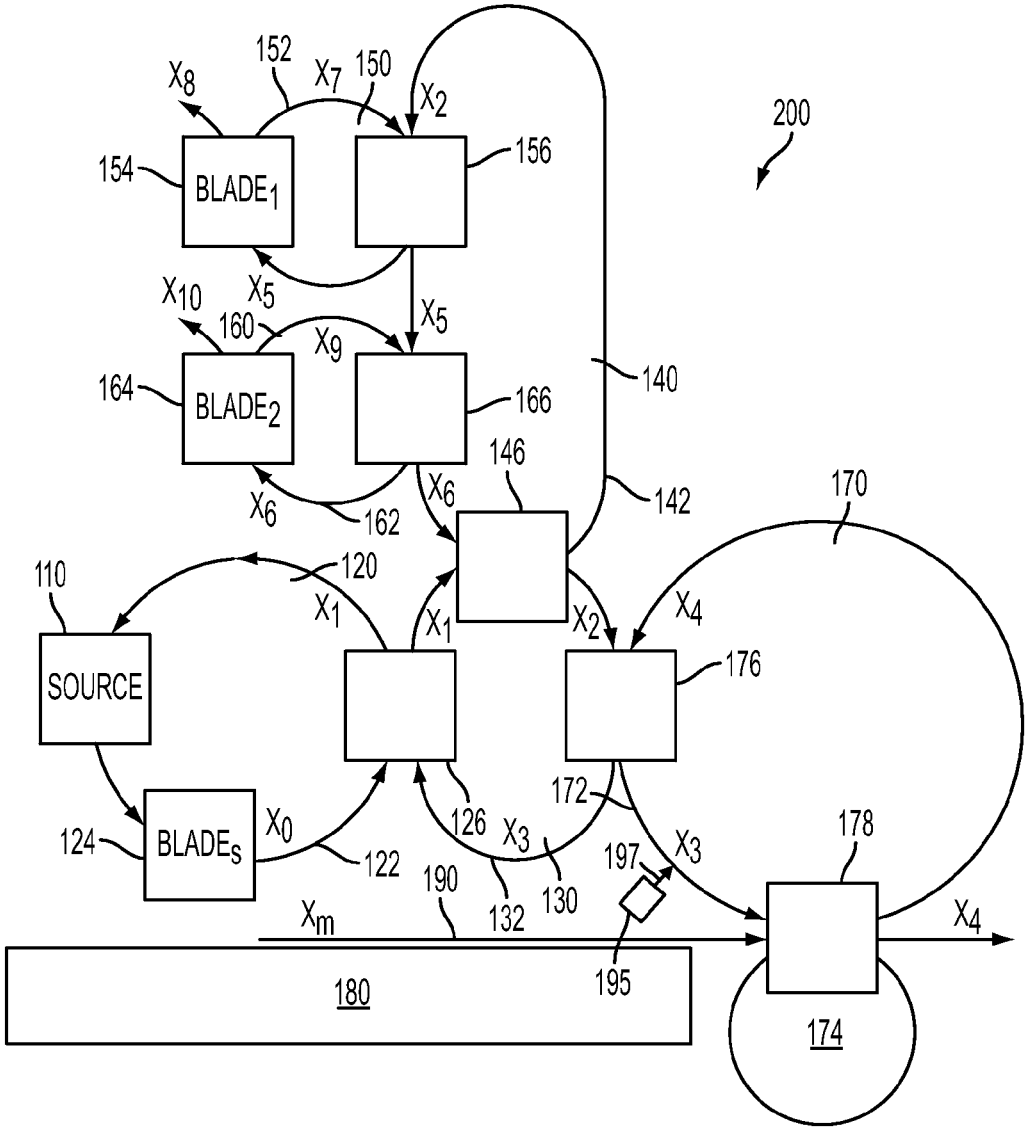
FIG. 2 is an exemplary illustration of an apparatus.

FIG. 2 is an exemplary illustration of an apparatus 200 according to a related embodiment that can include elements of the apparatus 100. The apparatus 200 can include a donor roll 130 rotatably supported in the apparatus 200. As used herein, the donor roll is not to be confused with a donor roll familiar in xerographic development. The donor roll 130 can have a donor roll surface 132 coupled between the source metering assembly surface 122 and the donor assembly surface 142. Thus, the donor assembly surface 142 can be coupled to the source metering assembly surface 122 via the donor roll surface 132. The donor roll surface 132 can be coupled between the donor assembly surface 142 and the print assembly surface 172. Thus, the print assembly surface 172 can be coupled to the donor assembly surface 142 via the donor roll surface 132. The donor roll surface 132 can be configured to transport fluid film from the source metering assembly surface 122 to the print assembly surface 172. The donor assembly surface 142 can be configured to transport fluid film from the source metering assembly surface 122 by transporting fluid film from the donor roll surface 132 received from the source metering assembly surface 122.

For example, the apparatus 200 can include a donor roll 130 rotatably supported in the apparatus 200. The donor roll 130 can have a donor roll surface 132 coupled between the source metering assembly surface 122 and the donor assembly surface 142 where the donor roll surface 132 can be coupled to the source metering assembly surface 122 at the source nip 126 and coupled to the donor assembly surface 142 at a donor belt nip 146. The donor roll surface 132 can be coupled between the donor assembly surface 142 and the print assembly surface 172 and the donor roll surface 132 can be coupled to the print assembly surface 172 at a fuser nip 176. The donor roll surface 132 can be configured to transport release agent from the source metering assembly surface 122 to the print assembly surface 172. The donor assembly surface 142 can then be configured to transport release agent from the source metering assembly surface 122 by transporting release agent from the donor roll surface 132 received from the source metering assembly surface 122.

Embodiments can provide for reducing the amount of release fluid film applied by a donor roller release agent management system. This can be accomplished by placing one or several fuser fluid reducing rollers, such as the second metering roll 152, in contact with a belt or roll system that is in contact with a donor roller. The fluid film application rate on media can then be reduced without impacting a source metering roll blade. Further fluid film reductions can also be possible using multiple fuser fluid reducing rollers than fluid film reductions that can be obtained with a single reducing roller. The use of a belt riding on a donor roll can also solve spatial problems and can allow for additional reducing rolls to be added to the system. Additional rolls can provide for more choices of fluid delivery rates by varying the number of rolls engaged at any one time.

A belt architecture can ride in contact with a donor roll, and allow the placement of multiple fluid reducing rollers. The efficiency of the system in reducing fuser fluid application rate can increase with each roller added. This concept can provide for the efficient use of space and the efficient placement of additional fluid reducing rollers.

Other related embodiments can provide for replacing a donor roll with a donor belt. The use of a donor belt can provide additional space for devices to reduce the amount of release fluid applied by a release agent management system. This can be accomplished by placing several fuser fluid reducing rollers in contact with a donor belt. The donor belt can transport fluid from a source metering roller to a print roll. The fluid reducing rollers can reduce the fluid application rate without impacting a source roll metering blade. Further fluid film reductions can also be possible using a donor belt with multiple fuser fluid reducing rollers than fluid film reductions that can be obtained with a single reducing roller with a donor roller. A separate belt riding in contact with the donor roll can further be eliminated and even further reductions are possible. Replacing a donor roller with a donor belt can eliminate some of the cost associated with the additional roller.

Assuming 50/50 fluid film splitting between surfaces at nips between the surfaces, a mass flow analysis of a combination of a donor belt with a donor roll indicates that the release agent amounts on the media 190 can be reduced to as low as 40% of an amount achieved without using a donor belt with a donor roll. The mass flow analysis of just the donor belt indicates that the release agent amounts on the media can be reduced up to 90% of an amount achieved without using a donor belt. The reduction in both cases can be dependent upon metering roll blade efficiency.

If blade efficiency is not 100%, lower application rates can be achieved using more rollers. Additional rollers can also make the fluid film application rate tunable in several ways, depending on the desired application rate desired. For example, the fluid film application rate can be tunable within a print job, between print jobs, or at other useful times. To further tune the fluid film application rate, fluid reducing rollers can be made addressable, which can be done by moving the rollers in and out of contact with the donor assembly 140 to produce multiple variable fluid rates. Also, blade critical parameters, such as metering blade loading, can be addressable and can be adjusted to deliver the desired amount of fluid removal from a fluid reducing roll, and consequently can control the amount of fluid making it onto the media 190.

Figure 3:
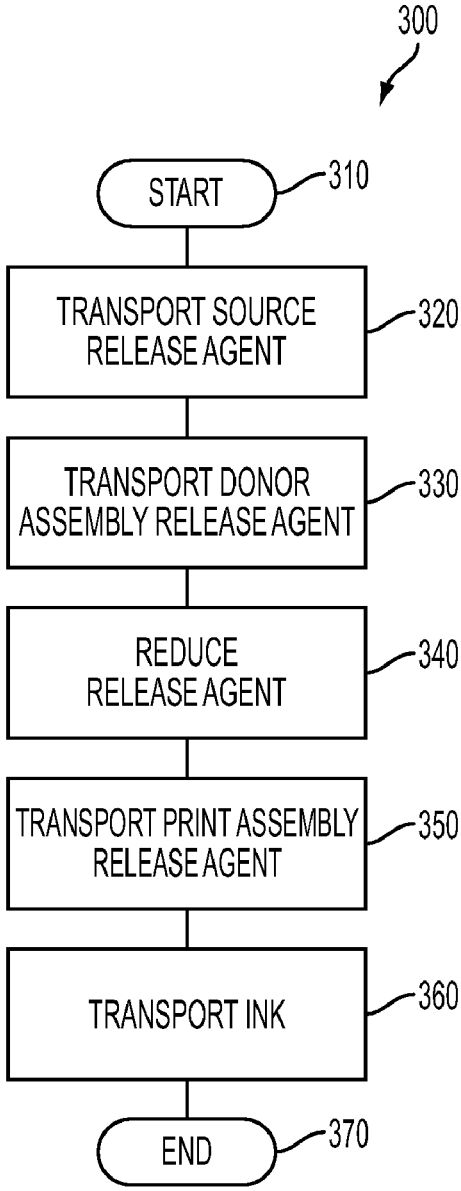
FIG. 3 is an exemplary flowchart of a method of metering fluid film in an apparatus.

FIG. 3 illustrates an exemplary flowchart 300 of a method of metering fluid film in an apparatus including a source of release agent and a source metering assembly rotatably supported in the apparatus, where the source metering assembly can have a source metering assembly surface coupled to the source of release agent. The apparatus can include a donor assembly rotatably supported in the apparatus, where the donor assembly can have a donor assembly surface coupled to the source metering assembly surface. The apparatus can include a metering roll rotatably supported in the apparatus, where the metering roll can have a metering roll surface coupled to the donor assembly surface. The apparatus can include a print assembly rotatably supported in the apparatus, where the print assembly can have a print assembly surface coupled to the donor assembly surface. The apparatus can include an ink jet printhead. The apparatus can also include a donor roll rotatably supported in the apparatus, where the donor roll can have a donor roll surface coupled between the source metering assembly surface and the donor assembly surface, and where the donor roll surface can be coupled between the donor assembly surface and the print assembly surface.

The method starts at 310. At 320, source release agent from the source of release agent is transported on the source metering assembly surface. If a donor roll is used, donor roll release agent from the source release agent on the source metering assembly surface can be transported on the donor roll surface. At 330, donor assembly release agent is transported on the donor assembly surface from the source release agent on the source metering roll surface. If a donor roll is used, donor assembly release agent from the donor roll release agent on the donor roll surface can be transported on the donor assembly surface to obtain reduced donor roll release agent on the donor roll surface. At 340, release agent on the donor assembly surface is reduced by transporting metering roll release agent on the metering roll surface from the donor assembly release agent on the donor assembly surface to obtain reduced release agent on the donor assembly surface. At 350, print assembly release agent is transported on the print assembly surface from the reduced donor assembly release agent on the donor assembly surface. If a donor roll is used, print assembly release agent from the reduced donor roll release agent on the donor roll surface can be transported on the print assembly surface. At 360, ink from the ink jet printhead along with print assembly release agent is transported on the print assembly surface. Transporting the ink can include transferring ink to media to produce an image on the media and transferring fuser assembly release agent to the media to assist in releasing the media from the print assembly. At 370, the method ends.

Figure 4:
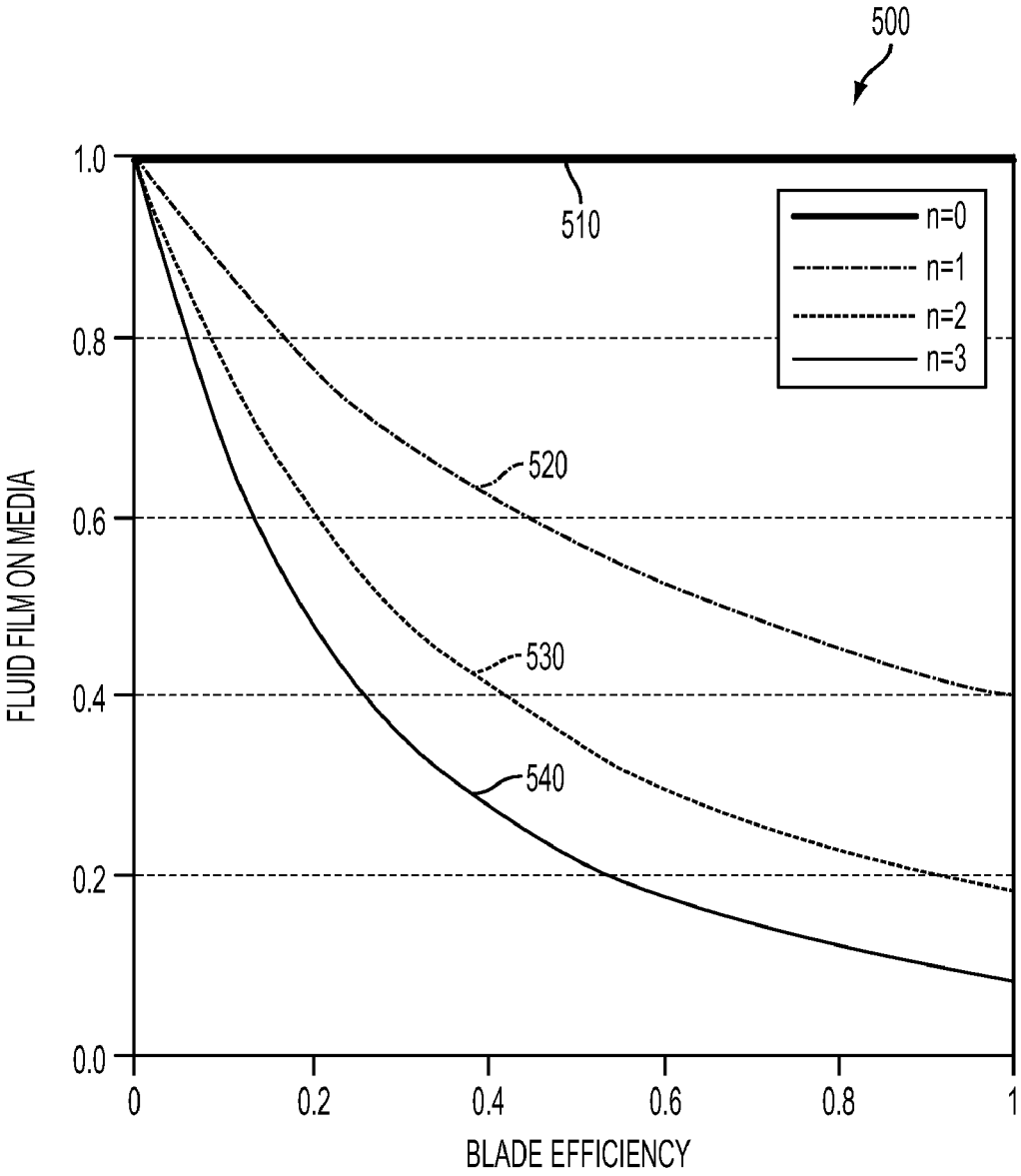
FIG. 4 is an exemplary graph showing possible amounts of fluid film on media.

FIG. 4 is an exemplary graph 500 showing possible amounts of fluid film on media. The graph 500 shows resulting fluid film on media when using a donor belt as a percentage of fluid film on media when the donor belt is not used as a function of metering blade fluid film removal efficiency. Embodiments can produce a variety of fluid rates depending upon the number n of metering rollers used and/or engaged at any one time. The graph 500 shows resulting fluid film on media when no metering roller is used 510, when one metering roller is used 520, when two metering rollers are used 530, and when three metering rollers are used 540.

Figure 5:
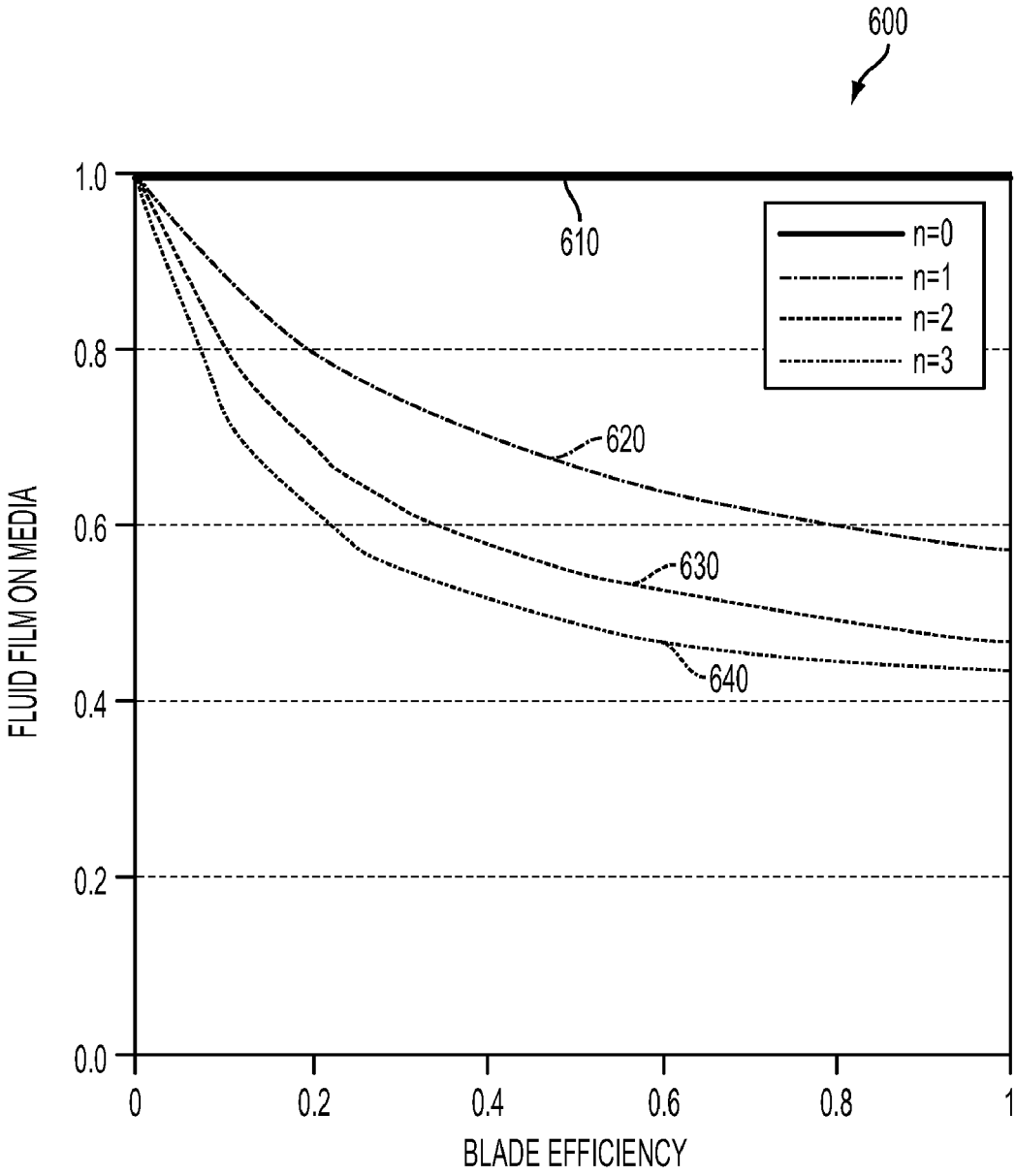
FIG. 5 is an exemplary graph showing possible amounts of fluid film on media.

FIG. 5 is an exemplary graph 600 showing possible amounts of fluid film on media. The graph 600 shows resulting fluid film on media when using a donor roll and a donor belt as a percentage of fluid film on media when the donor roll and donor belt are not used as a function of metering blade fluid film removal efficiency. Embodiments can produce a variety of fluid rates depending upon the number n of metering rollers used and/or engaged at any one time. The graph 600 shows resulting fluid film on media when no metering roller is used 610, when one metering roller is used 620, when two metering rollers are used 630, and when three metering rollers are used 640.

Figure 6:
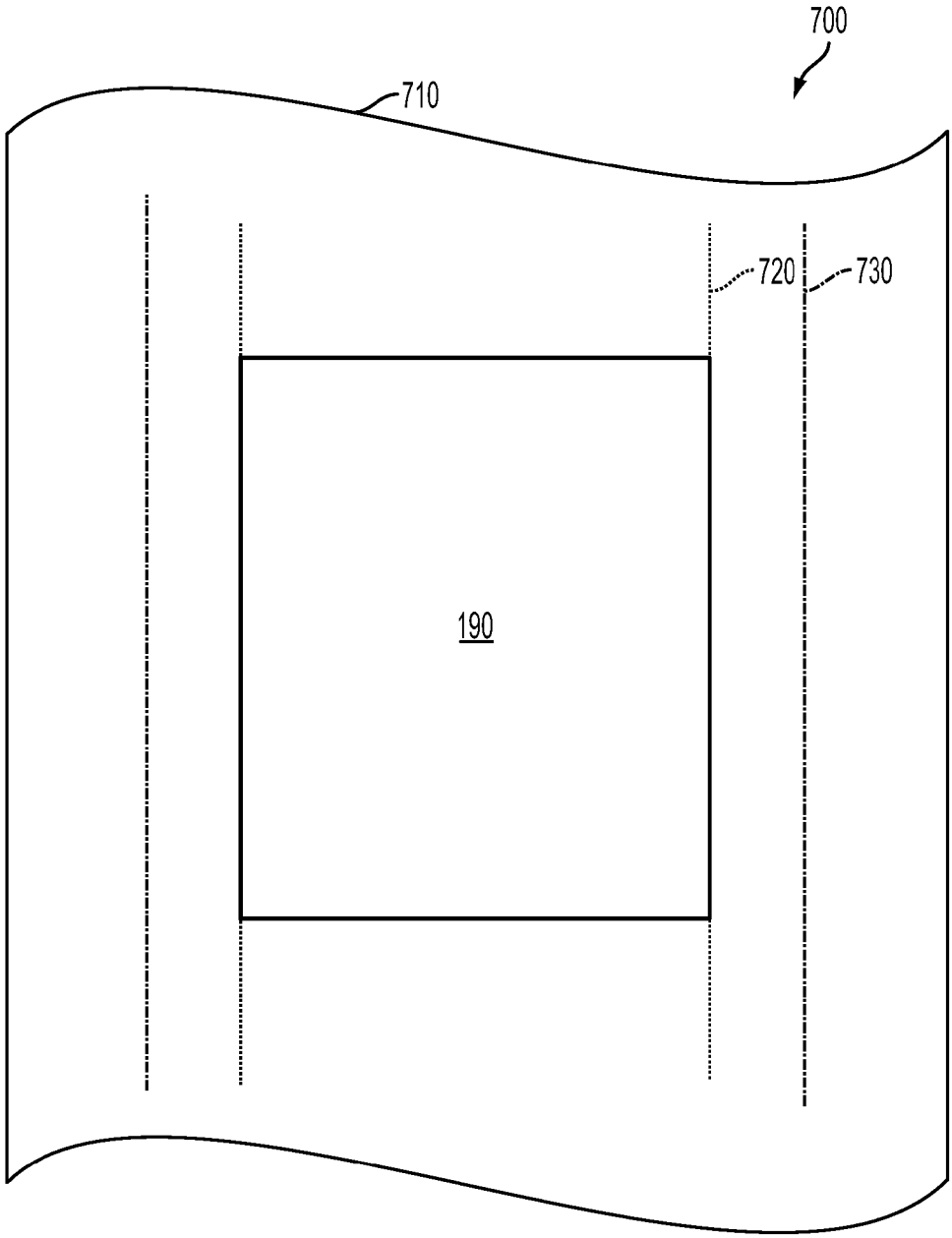
FIG. 6 is an exemplary illustration of an apparatus.

FIG. 6 is an exemplary illustration of an apparatus 700, such as a portion of the apparatus 100 or the apparatus 200. The apparatus 700 can include a surface 710, media 190, such as paper, an inside paper path (IPP) area 720, and an outside paper path (OPP) area 730. The surface 710 can be the print assembly surface 172. The media 190 is not necessarily entirely in contact with the surface 710 and may only contact a portion of the surface 710 such as a portion at a nip. Without the use of a donor assembly 140 and at least one second metering roll 150, fluid film that is not transferred to the media 190 in the inside paper path area 720 can build up on the outside paper path area 730. The size of the media 190 may be changed during operation on the fly, such as without performing a cycling out operation. If the media size is widened, excess fluid film on the former outside paper path area 730 can negatively impact image quality in the corresponding area 730 of a print on wider media. Using a donor assembly 140 and at least one second metering roll 150 to reduce the fluid film on a donor roll or donor belt surface can result in a lower OPP/IPP fluid film ratio on the surface 710 during operation. Lowering the OPP/IPP ratio can reduce the magnitude of image quality defects caused by high excess fluid buildup in the outside paper path area 730.

For example, the resulting fluid film $x_5$ inside the paper path 720 on the print assembly surface 172 in the apparatus 100 can be determined as a function of the fluid film $x_0$ on the source metering assembly surface 122 according to:

$$x_5 = \frac{1}{6(1+b)^n - 2} x_0$$

and the resulting fluid film $x_5$ outside the paper path 730 on the print assembly surface 172 in the apparatus 100 can be determined as a function of the fluid film $x_0$ on the source metering assembly surface 122 according to:

$$x_5 = \frac{1}{2(1+b)^n - 1} x_0$$

where $x_o$ can represent the fluid film on the source metering assembly surface 122 after the source metering blade 124, b can represent a blade efficiency from 0-1 where 1=100% removal of fluid film from a surface, n can represent the number of second metering rolls in contact with the donor assembly 140, and $x_m$=0. Assumptions can include a 50/50 split of fluid film on corresponding surfaces at each nip exit, no fluid film lost to external heat rolls, pressure rolls, or webs at steady state, and blade efficiency equal for all blades. The ratio for OPP/IPP fluid film on the print assembly surface 172 after the fuser nip 178 when using two second metering rolls 150 and 160 and blades 154 and 164, so n=2, can then be determined according to:

$$OPP/IPP = \frac{6(1+b)^2 - 2}{2(1+b)^2 - 1}$$

where the result is 4 for a blade efficiency of 0 and the result is 22/7 for a blade efficiency of 1.

According to algebraic determinations based on the above assumptions, the fluid film $x_5$ on the media 190 after the nip 178 is:

$x_5=x_0/4$ for n=0 and all values of b;

$x_5=x_0/4$ for b=0 and all values of n;

$x_5=x_0/10$ for n=1 and b=1;

$x_5=x_0/22$ for n=2 and b=1; and $x_5=x_0/46$ for n=3 and b=1.

As a further example, the resulting fluid film $x_4$ inside the paper path 720 on the print assembly surface 172 in the apparatus 200 can be determined as a function of the fluid film $x_0$ on the source metering assembly surface 122 according to:

$$x_4 = \frac{1}{\left(10 - \frac{6}{(1+b)^n}\right)} x_0$$

and the resulting fluid film $x_4$ outside the paper path 730 on the print assembly surface 172 in the apparatus 200 can be determined as a function of the fluid film $x_0$ on the source metering assembly surface 122 according to:

$$x_4 = \frac{1}{\left(3 - \frac{2}{(1+b)^n}\right)} x_0$$

where $x_o$ can represent the fluid film on the source metering assembly surface 122 after the source metering blade 124, b can represent a blade efficiency from 0-1 where 1=100% removal of fluid film from a surface, n can represent the number of second metering rolls in contact with the donor assembly 140, and $x_m$=0. Assumptions can include a 50/50 split of fluid film on corresponding surfaces at each nip exit, no fluid film lost to external heat rolls, pressure rolls, or webs at steady state, and blade efficiency equal for all blades. The ratio for OPP/IPP fluid film on the print assembly surface 172 after the fuser nip 178 when using two second metering rolls 150 and 160 and blades 154 and 164, so n=2, can then be determined according to:

$$OPP/IPP = \frac{\left(10 - \frac{6}{(1+b)^2}\right)}{\left(3 - \frac{2}{(1+b)^2}\right)}$$

where the result is 4 for a blade efficiency of 0 and the result is 17/5 for a blade efficiency of 1.

According to algebraic determinations based on the above assumptions, the fluid film $x_4$ on the media 190 after the nip 178 is:

$x_4=x_0/4$ for n=0 and all values of b;

$x_4=x_0/4$ for b=0 and all values of n;

$x_4=x_0/7$ for n=1 and b=1;

$x_4=x_0/17$ for n=2 and b=1; and $x_4=x_0/37$ for n=3 and b=1.

Figure 7:
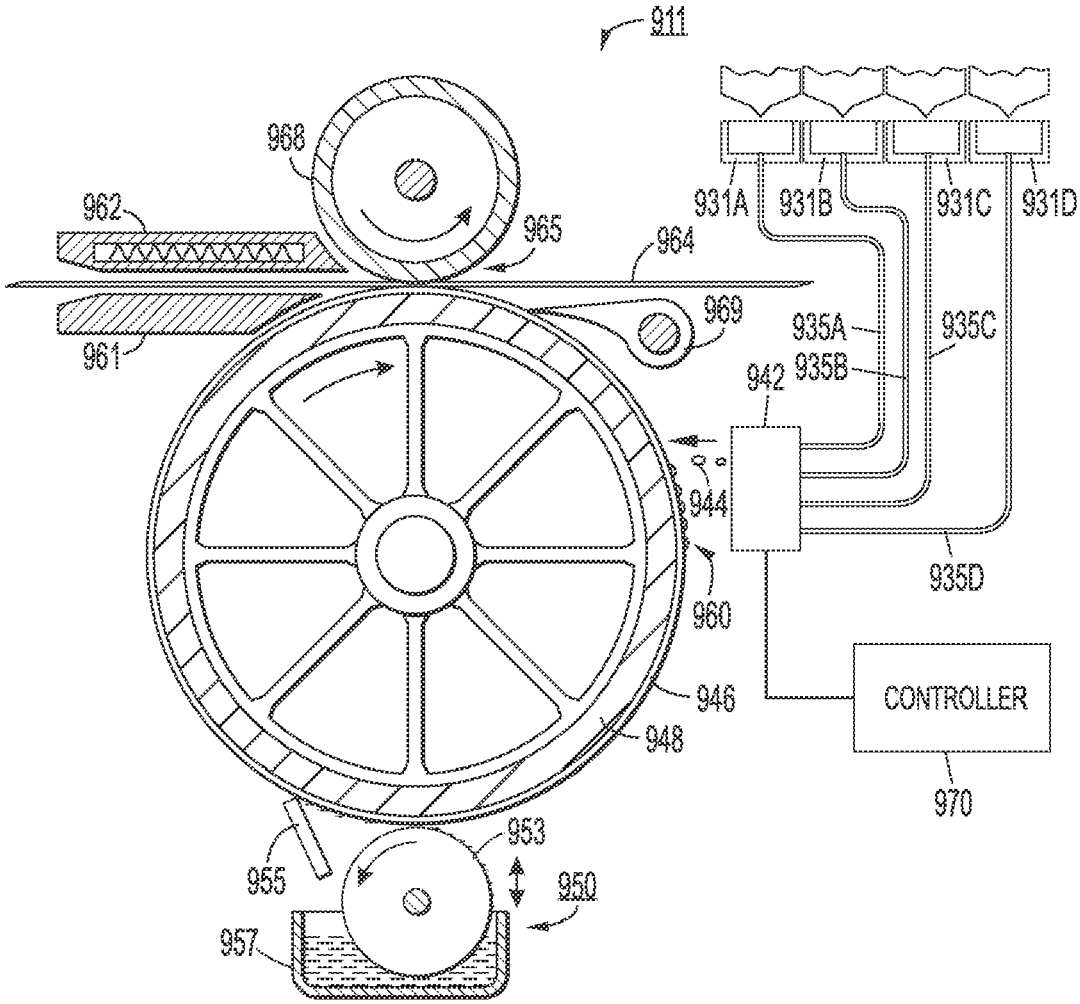
FIG. 7 (PRIOR ART)
FIG. 7 is an exemplary illustration of a printing apparatus.

FIG. 7 is a schematic block diagram of an embodiment of an ink jet printing mechanism 911 that can include or be part of the apparatus 100. The printing mechanism 911 can include a printhead 942 that is appropriately supported for stationary or moving utilization to emit drops 944 of ink onto an intermediate transfer surface 946 applied to a supporting surface of a print drum 948. The print drum 948 can be the print assembly 170 of the apparatus 100. The ink is supplied from the ink reservoirs 931A, 931B, 931C, and 931D of the ink supply system through liquid ink conduits 935A, 935B, 935C, and 935D that connect the ink reservoirs 931A, 931B, 931C, and 931D with the printhead 942. The intermediate transfer surface 946 can be a fluid film, such as a functional oil, that can be applied by contact with an applicator such as a roller 953 of an applicator assembly 950. By way of illustrative example, the applicator assembly 950 can include a metering blade 955 and a reservoir 957. The applicator assembly 950 can be configured for selective engagement with the print drum 948. The applicator assembly 950 can use the donor assembly 140 (not shown) between the roller 953 and the print drum 948 in a similar manner the donor assembly 140 is used between the source of fluid film 110 and the print assembly 170. In the illustrative embodiment, the print drum 948 can operate in two rotation cycles where, in a first rotation cycle, the intermediate transfer surface 946 can be applied to the print drum 948 and in a second rotation cycle, the applicator assembly 950 can disengage from the print drum 948 and the printhead 942 can emit drops 944 of ink onto the intermediate transfer surface 946. In another embodiment, the applicator assembly 950 can precede the printhead 942 in an operational direction of the print drum 948 and both the intermediate transfer surface 946 and the ink 944 can be applied to the print drum 948 in one cycle.

The printing mechanism 911 can further include a substrate guide 961 and a media preheater 962 that guides a print media substrate 964, such as paper, through a nip 965, such as the nip 178, formed between opposing actuated surfaces of a roller 968, such as the pressure roll 174, and the intermediate transfer surface 946 supported by the print drum 948. Stripper fingers or a stripper edge 969 can be movably mounted to assist in removing the print medium substrate 964 from the intermediate transfer surface 946 after an image 960 comprising deposited ink drops is transferred to the print medium substrate 964.

A print controller 970 can be operatively connected to the printhead 942. The print controller 970 can transmit activation signals to the printhead 942 to cause selected individual drop generators of the printhead 942 to eject drops of ink 944. The activation signals can energize individual drop generators of the printhead 942.

Embodiments can provide for an efficient and cost effective way to reduce fluid film rate on media while maintaining a good release surface for media on a print assembly and alleviating dependency on metering blade edge quality. In addition, embodiments can provide a robust solution to space constraints in print subsystems and can provide improved method of controlling and maintaining a uniform fluid film layer on inside and outside paper path areas to minimize image quality artifacts associated with switching media size.

Embodiments can incorporate a fluid reducing belt in contact with donor roll in a release agent management system. In order to provide more effective oil reduction on the print assembly and printed media, a belt can variably be in contact with multiple reduction rollers and blades as compared to a single roll. A donor belt can also be used instead of a donor roll in a release agent management system. In order to provide more effective oil reduction on the print assembly and printed media, the belt can be in contact with multiple oil reduction rollers and blades as contrasted with single roll. Embodiments can be used in other applications where uniform thin film of lubricant or ink is required, especially if the system is bound by special constraints. Embodiments can also be applied to other xerographic products that utilize a fluid film media release system. In addition, embodiments can be applied to other industries that rely on metering out thin film or ink that have special constraints, such as applied to other industries for metering out select amounts of lubrication.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus useful in ink jet printing comprising:

a source of fluid film;

a source metering assembly rotatably supported in the apparatus, the source metering assembly having a source metering assembly surface coupled to the source of fluid film, the source metering assembly surface configured to transport fluid film from the source of fluid film;

a donor assembly rotatably supported in the apparatus, the donor assembly having a donor assembly surface coupled to the source metering assembly surface, the donor assembly surface configured to transport fluid film from the source metering assembly surface;

an ink jet printhead configured to emit ink; and a print assembly rotatably supported in the apparatus, the print assembly having a print assembly surface coupled to the donor assembly surface, the print assembly surface configured to transport fluid film from the donor assembly surface and the print assembly configured to receive ink from the ink jet printhead and produce an image on media using the ink; wherein the donor assembly comprises a donor belt having a donor belt surface coupled to the source metering assembly surface, the donor belt surface configured to transport fluid film from the source metering assembly surface, and wherein the apparatus further comprises a metering roll rotatably supported in the apparatus, the metering roll having a metering roll surface coupled to the donor belt surface, the metering roll surface configured to transport fluid film from the donor belt surface.

2. The apparatus according to claim 1, further comprising a metering blade coupled to the donor roll surface, the metering blade configured to remove fluid film from the donor roll surface.

3. The apparatus according to claim 1, wherein the metering roll surface is configured to reduce fluid film on the donor belt surface by transporting fluid film away from the donor belt surface.

4. The apparatus according to claim 1, wherein the metering roll surface is detachably coupled to the donor belt surface.

5. The apparatus according to claim 1, wherein at least the metering roll is configured to return fluid film to the source of fluid film.

6. The apparatus according to claim 1, further comprising a metering blade coupled to the metering roll surface, the metering blade configured to remove fluid film from the metering roll surface.

7. The apparatus according to claim 6, wherein the metering blade is variably coupled to the metering roll surface to vary the removal of fluid film from the metering roll surface by the metering blade.

8. The apparatus according to claim 1, further comprising a donor roll rotatably supported in the apparatus, the donor roll having a donor roll surface coupled between the source metering assembly surface and the donor belt surface, the donor roll surface coupled between the donor belt surface and the print assembly surface, the donor roll surface configured to transport fluid film from the source metering assembly surface to the print assembly surface, wherein the donor belt surface is configured to transport fluid film from the source metering assembly surface by transporting fluid film from the donor roll surface received from the source metering assembly surface.

9. The apparatus according to claim 1, further comprising a second metering roll rotatably supported in the apparatus, the second metering roll having a second metering roll surface coupled to the donor belt surface, the second metering roll surface configured to transport fluid film from the donor belt surface.

10. The apparatus according to claim 1, wherein the print assembly comprises a print drum.

11. The apparatus according to claim 1, wherein the fluid film comprises a release agent.

12. An apparatus useful in ink jet printing comprising:

a media transport configured to transport media;

a source of release agent;

a source metering assembly rotatably supported in the apparatus, the source metering assembly having a source metering assembly surface coupled to the source of release agent, the source metering assembly surface configured to transport release agent;

a donor assembly having a donor assembly surface coupled to the source metering assembly surface at a source nip, the donor assembly surface configured to transport release agent from the source metering assembly surface;

a print assembly having a print assembly surface coupled to the donor assembly surface, the print assembly surface configured to transport reduced release agent transported from the donor assembly surface;

an ink jet printhead configured to emit ink onto the print assembly surface; and an ink jet supply coupled to the ink jet printhead, the ink jet supply configured to deliver the ink to the ink jet printhead, wherein the print assembly is configured and produce an image on the media using the ink from the ink jet printhead; wherein the donor assembly comprises a donor belt having a donor belt surface coupled to the source metering assembly surface at a source nip, the donor belt surface configured to transport release agent from the source metering assembly surface, wherein the apparatus comprises a metering roll rotatably supported in the apparatus, the metering roll having a metering roll surface coupled to the donor belt surface at a metering roll nip, the metering roll surface configured to reduce release agent transported from the source metering assembly surface on the donor belt surface.

13. The apparatus according to claim 12, wherein the donor assembly comprises a donor roll having a donor roll surface coupled to the source metering assembly surface, the donor roll surface configured to transport fluid film from the source metering assembly surface.

14. The apparatus according to claim 12, further comprising a donor roll rotatably supported in the apparatus, the donor roll having a donor roll surface coupled between the source metering assembly surface and the donor belt surface, the donor roll surface coupled to the source metering assembly surface at the source nip and coupled to the donor belt surface at a donor belt nip, the donor roll surface coupled between the donor belt surface and the print assembly surface, the donor roll surface configured to transport release agent from the source metering assembly surface to the print assembly surface, wherein the donor belt surface is configured to transport release agent from the source metering assembly surface by transporting release agent from the donor roll surface received from the source metering assembly surface.

* * * * *